US005272943A

United States Patent [19]

Edwards

[11] Patent Number: 5,272,943

[45] Date of Patent: Dec. 28, 1993

[54] APPARATUS FOR REMOVING AND REPLACING SPIKES IN GOLF SHOES

[76] Inventor: Robert R. V. Edwards, 5216 Moccasin Trail, Louisville, Ky. 40207

[21] Appl. No.: 891,776

[22] Filed: Jun. 1, 1992

[51] Int. Cl.[5] ..... B25B 23/00

[52] U.S. Cl. ..... 81/461; 81/176.15

[58] Field of Search ..... 81/176.1, 176.15, 176.2, 81/176.3, 461

[56] References Cited

U.S. PATENT DOCUMENTS

| | | | |
|---|---|---|---|
| 2,402,477 | 6/1946 | Williams | 81/176.15 |
| 2,525,222 | 10/1950 | Holt | 81/176.15 |
| 2,605,664 | 8/1952 | Galbraith | 81/176.15 |
| 2,770,991 | 11/1956 | Myers | 81/176.15 |
| 3,140,625 | 7/1964 | Pannozzo | 81/176.15 |
| 3,259,000 | 7/1966 | Lasch, Sr. | 81/176.15 |
| 3,412,635 | 11/1968 | Chmielewski | 81/176.15 |
| 4,831,904 | 5/1989 | Agins | 81/176.15 |
| 5,005,279 | 4/1991 | Kooiker | 81/176.15 |

FOREIGN PATENT DOCUMENTS

| | | | |
|---|---|---|---|
| 157750 | 1/1953 | Australia | 81/176.15 |

*Primary Examiner*—James G. Smith
*Attorney, Agent, or Firm*—Middleton & Reutlinger

[57] ABSTRACT

An apparatus for removing and replacing spikes, or calks, in golf shoes. This apparatus may be fitted into a driver for powered operation or may have a handle for manual operation. The pins of the apparatus which engage the spike wrench receptacles in the collar of a spike are "mobile" with respect to the spike holder, so that the spike wrench receptacles in the collar of a spike can be more readily engaged, facilitating removal and replacement of spikes on golf shoes. The apparatus comprises a spike holder, a pair of pins, a hex bit, and a collar nut. Preferably, each of these elements is of unitary construction.

10 Claims, 1 Drawing Sheet

APPARATUS FOR REMOVING AND REPLACING SPIKES IN GOLF SHOES

BACKGROUND OF THE INVENTION (a) Field of the Invention

The present invention relates to an apparatus for removing and replacing spikes, or calks, in golf shoes. This apparatus may be fitted into a driver for powered operation or may have a handle for manual operation. At least one and preferable both of the two pins of the apparatus which engage the spike wrench receptacles in the collar of a spike are "mobile" with respect to the spike holder, so that the spike wrench receptacles in the collar of a spike can be more readily engaged, facilitating removal and replacement of spikes on golf shoes. I have found that the mobile pins are extremely helpful when removing and replacing spikes having collars made of plastic, or the like. It appears to me that plastic collared spikes have wider manufacturing tolerances than do metal collared spikes, so it is sometimes very difficult to remove and replace spikes, particularly those having plastic collars, with an apparatus having fixed instead of mobile pins. However, my apparatus will work with spikes made of any material, including, for example, metal and plastic.

(b) Description of the Prior Art

All prior art of which I am aware teaches apparatuses for removing and replacing spikes which have rigid pins, or the like, which engage the spike wrench receptacles in the collar of a spike. U.S. Pat. No. 3,412,635, to Chmielewski, teaches a golf shoe calk wrench having a cylindrical stem 5 with enlarged head 6 Head 6 has an interior axial conical recess 7 terminating in outwardly flared concave face 8. Head 6 has a circular flat top 9. Diametrically opposed longitudinal apertures 10 extend from top 9 to face 8 and receive pins 11 having flat heads 12. Nut 13 threads onto threads 15 on stem 5 to rigidly fix pins 11 into apertures 10 so that pins 11 longitudinally extend from apertures 10 at face 8. Pins 11 are fixed with respect to head 6.

U.S. Pat. No. 2,448,805, to Ingram, teaches an adjustable detent wrench for screw calks having handle 8 having nut 30 threaded around handle 8 toward the head 10 end. Between nut 30 and head 10 are ring 24 and spring 34. Head 10 has a saucershaped face 14 with axial bore 18 to receive spikes. Diametrically opposed longitudinal bores pass from face 14 through head 10 and partway into ring 24. Detents 22 and 23 are inserted therein. Adjusting nut 30 extends or retracts detents 22 and 23 from face 14. However, once adjusted, the detents 22 and 23 are rigid with respect to head 10.

SUMMARY OF THE INVENTION

The present invention is for an apparatus for removing and replacing spikes, or calks, in golf shoes. This apparatus may be fitted into a driver for powered operation or may have a handle for manual operation. At least one and preferable both of the two pins of the apparatus which engage the spike wrench receptacles in the collar of a spike are mobile with respect to the spike holder, so that the spike wrench receptacles in the collar of a spike can be more readily engaged, facilitating removal and replacement of spikes on golf shoes.

In particular, the present invention comprises an apparatus for removing and replacing spikes in golf shoes, including a spike holder; a pair of mobile pins inserted through bores in the spike holder and extending therefrom for engaging spike wrench receptacles in the collar of a golf spike; a hex bit having one end firmly engaged into the spike holder and the other end for interfacing with a power operated driver; and, a collar nut to contain the pins in their respective bores.

More particularly, the present invention comprises an apparatus for removing and replacing spikes in golf shoes, comprising: means to engage the spike wrench receptacles of a spike, said engagement means including a pin holder and a pair of pins, at least one of said pins being mobile with respect to said pin holder.

Finally, the present invention comprises an apparatus for removing and replacing spikes in golf shoes, comprising:

a. a collar nut, said nut having a hollow cylindrical shape with an inside surface, said inside surface being threaded;

b. a shaft, said shaft having an axis, said shaft having a hexagonal shaped portion axially toward a first end and a circular portion axially toward a second end;

c. a pair of pins, each pin having a cylindrical shaft, said shaft having a collar end and a spike end, said shaft having a first diameter and a first length, each pin further having a head, said head being attached to said collar end of said shaft, said head having a second diameter and a second length, said second diameter being greater than said first diameter; and, d. a spike holder; said spike holder having an axis; said spike holder having a circular shaped first end portion and an axially opposed sleeve, said sleeve having a threaded outside surface, said sleeve having an axial bore therein, said axial bore securely receiving said circular portion of said shaft; said circular shaped first end portion having a diameter, a spike face and a collar face, said spike face having an axial spike receptacle opening therein; said spike receptacle opening, said axial bore of said sleeve, and said shaft having a common axis; said circular shaped first end portion having a pair of diametrically opposed bores therethrough, said bores being from said collar face to said spike face, each bore having an axis such that said axis of each bore and said axis of said spike holder are parallel and the axis of each bore is equidistant from said axis of said spike holder and diametrically opposed thereto, each said bore having a head receiving portion toward said collar face and a shaft receiving portion toward said spike face, said head receiving portion having a third diameter and a third length, said third diameter being greater than said second diameter of said head of each said pin, said third length being greater than said second length of said head, said shaft receiving portion having a fourth diameter and a fourth length, said fourth diameter being greater than said first diameter of said shaft of each said pin, said first length of said shaft of each said pin and said second length of said head of each said pin being greater than said third length of said head receiving portion and said fourth length of said shaft receiving portion; each of said pair of pins being inserted into one of said pair of diametrically opposed bores, said head being toward said collar face and said shaft being toward said spike face; said collar nut being securely threaded onto said sleeve of said spike holder thereby securing said pair of pins in said diametrically opposed bores; whereby said pair of pins extend from said bores at said spike face, said pins being mobile with respect to said spike holder.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
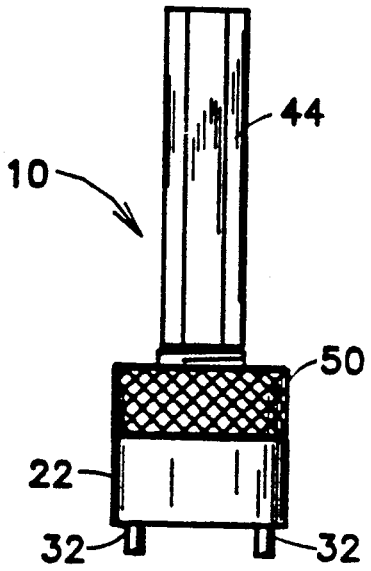
FIG. 1 shows a perspective view of one embodiment for an apparatus for removing and replacing spikes in golf shoes which is embodied as an attachment for a power operated driver.
Figure 2:
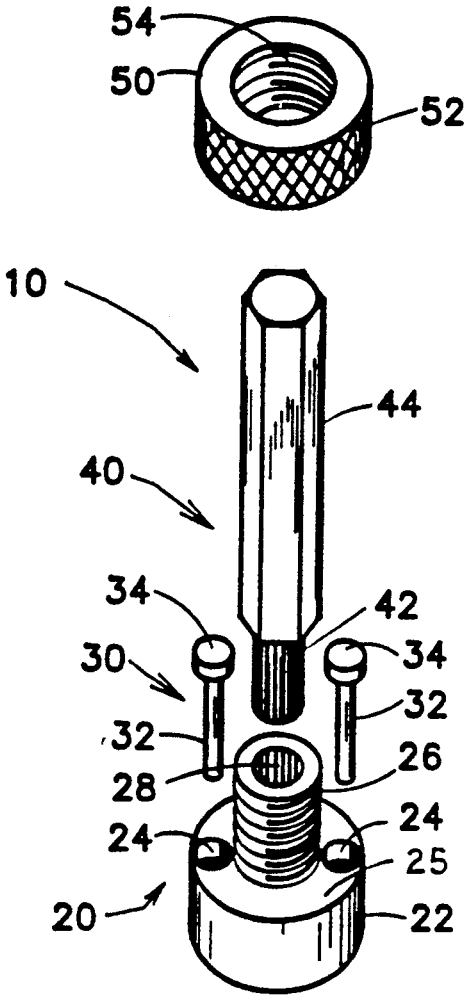
FIG. 2 shows an exploded view of the apparatus of FIG. 1.
Figure 3:
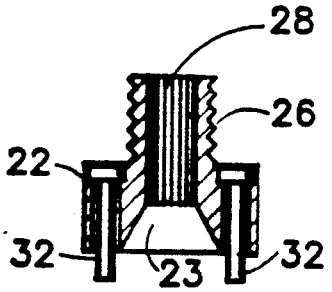
FIG. 3 shows a cross-sectional view of the spike holder and pins therein of the apparatus of FIG. 1; and, FIG. 4 shows a bottom view of the apparatus of FIG. 1.
Figure 4:
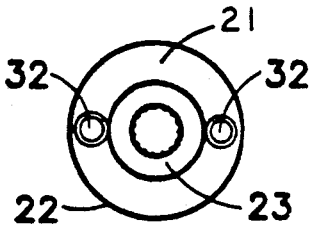

With reference to the Figures, one preferred embodiment for an apparatus 10 for removing and replacing spikes in golf shoes is shown. As shown, the apparatus of this preferred embodiment is an attachment for a power-operated driver (not shown). Apparatus 10 can be used with any conventional off-the-shelf driver which is capable of receiving the end of a hex bit 40 therein, for example, Black & Decker ® models 9018 or 9038 and Skil ® models 2105 or 2205. However, those skilled in the art can see that hex bit 40 could easily be replaced by a "T-handle"-type bit, or an additional handle could be attached to the driver receiving end of hex bit 40 for manual operation. Also, in this preferred embodiment, as described hereinafter, both pins 30 which engage the spike wrench receptacles of a spike are "mobile". Those skilled in the art can see that one pin could be firmly secured and the other pin could be mobile, with similar results.

Apparatus 10, a means to engage the spike wrench receptacles of a spike, comprises a spike or pin holder 20, a pair of pins 30, hex bit or shaft 40, and a collar nut 50. Preferably, each of these elements is of unitary construction.

Spike holder 20 includes a circular-shaped end portion 22 with a nozzle-shaped axial spike receiving opening 23 therein. For example, circular-shaped end portion 22 may have a diameter of 1 inch and a thickness of 5/16 inch extending between a spike face 21 and a collar face 25. Spike holder 20 further includes a outside threaded sleeve 26 adjacent collar face 25, having, for example, an external diameter of 5/16 inch with threads and a thickness of 5/16 inch. Sleeve 26 has an axial bore 28 therethrough. Bore 28 and nozzle-shaped opening 23 are in an abutting axial alignment relationship. The surface of sleeve 26 inside bore 28 will be discussed hereinafter relating to hex bit 40. A pair of diametrically opposed bores 24 extend through circular-shaped end portion 22 from collar face 25 to spike face 21. The axis of each bore 24 and the common axis of bore 28 and nozzle-shaped opening 23 are in a parallel relationship. At the collar face 25, each bore 24 has an enlarged diameter. The reason for this, as well as the spaced relationship of bores 24 will be explained hereinafter. The diameter of bores 24 can be, for example, approximately 3/32 inch, with an increased diameter to approximately 7/32 inch at collar face 25.

Each pin 30 has a cylindrical shaft 32, having, for example, a diameter of 1/16 inch and a length of approximately 7/16 inch. Further, each pin 30 has a flat head 34 having a diameter greater than that of shaft 32, for example, 3/16 inch. Each pin 30 is inserted into a bore 24 with head 34 being at the collar face 25 end of circular-shaped end portion 22.

Because of the dimensional relationships, pins 30 extend from bores 24 at the spike face 21 end of circular-shaped end portion 22. Bores 24 ar axially positioned so that pins 30 inserted therethrough will properly engage the spike wrench receptacles in the collar of a golf shoe spike. For example, in golf shoe spikes which I have examined, the centers of the two spike wrench receptacles on the collar of the golf spikes are separated by a distance of approximately 9/16 inch. Further, for example, spike wrench receptacles are generally circular, sometimes passing completely through the spike collar and sometimes merely being indented into the spike collar, each receptacle having a diameter of from approximately 3/32 to ⅛ inch. I am sure that there are other spikes with other dimensions, and my apparatus will work to remove and replace them as long as pins 30 can properly engage the spike wrench receptacles in the spike collars.

Hex bit 40 has a driver engaging portion 44 and a spike holder 20 engaging portion 42. As shown in the Figures, driver engaging portion 44 is shown having, for example, a hexagonal shape with a diameter of ¼ inch and a length of at least 13/16 inch. This permits driver engaging portion 44 to be inserted into any suitable off-the-shelf power operated driver. To withstand the rotational forces involved with the removal and replacement of golf shoe spikes, the spike holder 20 engaging portion 42 must be able to be securely received into bore 28 of sleeve 26. As shown in the Figures, for example, driver engaging portion 42 is of circular shape and has spline cuts into an outer surface which run parallel to the axis of hex bit 40, spike holder 20 engaging portion 42 having a length of approximately 5/16 inch. The surface of bore 28 of sleeve 26 also has spline cuts therein, spike holder 20 engaging portion 42 therefore being securely received into bore 28 and being firmly held therein. Bore 28, nozzle-shaped opening 23, and hex bit 40 share a common axis.

Collar nut 50 is has the shape of a hollow cylinder with, for example an outside diameter of approximately 1 inch and a thickness of ¼ inch. A threaded inside surface 54 has, for example, a diameter of ⅜ inch, and is received over hex bit 40 an threaded onto outside threaded sleeve 26 to abut collar face 25 of spike holder 20. To facilitate this threading, collar nut 50 can have, for example, an outside cylindrical knurled surface 52. With collar nut 50 threaded onto sleeve 26, pins 30 are secured into respective bores 24. The dimensional relationships between the cylindrical shaft 32 and flat head 34 of each pin 30 and its respective bore 24 having an enlarged diameter at collar face 25 allows each pin 30 to be mobile in relation to the spike holder 20. This ability to be mobile, or to wiggle, facilitates engaging pins 30 into the spike wrench receptacles on the collar of a spike, thereby making removing and replacing spikes easier.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. An apparatus to be employed with a hexagonal shaft driver for removing and replacing spikes in golf shoes, comprising:

a. a collar nut, said nut having a hollow cylindrical shape with an inside surface, said inside surface being threaded;

b. a shaft, said shaft having an axis, said shaft having a hexagonal shaped portion axially toward a first end and a circular portion axially toward a second end, whereby said hexagonal shaped portion is to be received by the hexagonal shaft driver;

c. a pair of longitudinal pins, each longitudinal pin having a cylindrical shaft, said cylindrical shaft having a collar end and a spike end, said cylindrical shaft having a first diameter and a first length, each longitudinal pin further having a head, said head being attached to said collar end of said cylindrical shaft, said head having a second diameter and a second length, said second diameter being greater than said first diameter; and, d. a spike holder; said spike holder having a longitudinal axis; said spike holder having a circular shaped first end portion and an axially opposed sleeve, said sleeve having a threaded outside surface, said sleeve having an axial bore therein, said axial bore securely receiving said circular portion of said shaft; said circular shaped first end portion having a diameter, a spike face and a collar face, said spike face having an axial spike receptacle opening therein; said spike receptacle opening, said axial bore of said sleeve, and said shaft having a common axis; said circular shaped first end portion having a pair of diametrically opposed longitudinal bores therethrough, said bores being from said collar face to said spike face, each bore having an axis such that said axis of each bore and said longitudinal axis of said spike holder are parallel and the axis of each bore is equidistant from said longitudinal axis of said spike holder and diametrically opposed thereto, each said bore having a head receiving portion toward said collar face and a cylindrical shaft receiving portion toward said spike face, said head receiving portion having a third diameter and a third length, said third diameter being greater than said second diameter of said head of each said longitudinal pin, said third length being greater than said second length of said head, said cylindrical shaft receiving portion having a fourth diameter and a fourth length, said fourth diameter being greater than said first diameter of said shaft of each said longitudinal pin, said first length of said shaft of each said longitudinal pin and said second length of said head of each said longitudinal pin being greater than said third length of said head receiving portion and said fourth length of said cylindrical shaft receiving portion; each of said pair of longitudinal pins being inserted into one of said pair of diametrically opposed longitudinal bores, said head being toward said collar face and said shaft being toward said spike face; said collar nut being securely threaded onto said sleeve of said spike holder thereby securing said pair of longitudinal pins in said diametrically opposed longitudinal bores; wherein said pair of longitudinal pins extend form said bores at said spike face, said longitudinal pins being latitudinal movable with respect to said spike holder longitudinal axis.

2. The apparatus of claim 1, wherein said axial spike receptacle opening in said spike face has a truncated conical shape, having a largest diameter at said spike face.

3. The apparatus of claim 1, wherein said fourth diameter has a value which is one and a half times said first diameter.

4. The apparatus of claim 3, wherein said first diameter is 1/16 inch and said fourth diameter is 3/32 inch.

5. An apparatus for removing and replacing spikes in golf shoes, comprising: means to engage a spike's spike wrench receptacles, said engagement means including a pin holder and a pair of longitudinally extending pins, said pair of longitudinally extending pins being retained by said pin holder, said pin holder having a pair of substantially parallel longitudinal bores therein, each longitudinal bore having one of said pair of longitudinally extending pins contained partway therein and extending therefrom, said pair of longitudinally extending pins being in a substantially parallel alignment, at least one of said longitudinally extending pins being latitudinal movable with respect to said pin holder, wherein each of said longitudinally extending pins have a longitudinal cylindrical shaft said longitudinal cylindrical shaft having a first diameter; and, wherein at least one of said pair of substantially parallel longitudinal bores has a second diameter, said second diameter being one and a half times said first diameter.

6. The apparatus of claim 5, wherein said first diameter is 1/16 inch and said second diameter is 3/32 inch.

7. An apparatus for removing and replacing spikes in golf shoes, comprising: means to engage a spike's spike wrench receptacles, said engagement means including a pin holder and a pair of longitudinally extending pins, said pair of longitudinally extending pins being retained by said pin holder said pin holder having a pair of substantially parallel longitudinal bores therein, each longitudinal bore having one of said pair of longitudinally extending pins contained partway therein and extending therefrom, said pair of longitudinally extending pins being in a substantially parallel alignment, wherein said pair of longitudinally extending pins are latitudinal movable with respect to said pin holder wherein each of said longitudinally extending pins have a longitudinal cylindrical shaft, said longitudinal cylindrical shaft having a first diameter; and, wherein each of said pair of substantially parallel longitudinal bores has a second diameter said second diameter being one and a half times said first diameter.

8. The apparatus of claim 7, wherein said first diameter is 1/16 inch and said second diameter is 3/32 inch.

9. An apparatus for removing and replacing spikes on golf shoes, comprising: means to engage a spike's spike wrench receptacles, said engagement means including a pin holder, a pair of longitudinally extending pins, and a shaft longitudinally extending therefrom; said shaft being for rotating said engagement means and thereby said pair of longitudinally extending pins; said pair of longitudinally extending pins being retained by said pin holder; said pin holder having a pair of substantially parallel longitudinally bores therein, each longitudinal bore having one of said pair of longitudinally extending pins being latitudinal movable with respect to said pin holder, wherein each of said longitudinally extending pins have a longitudinal cylindrical shaft said longitudinal cylindrical shaft having a first diameter; and, wherein at least one of said pair of substantially parallel longitudinal bores has a second diameter, said second diameter being one and a half times said first diameter.

10. The apparatus of claim 9, wherein said first diameter is 1/16 inch and said second diameter is 3/32 inch.

* * * * *

UNITED STATES PATENT AND TRADEMARK OFFICE

CERTIFICATE OF CORRECTION

PATENT NO. : 5,272,943

DATED : Dec. 28, 1993

INVENTOR(S) : Robert R. V. Edwards, Louisville, KY

It is certified that error appears in the above-identified patent and that said Letters Patent is hereby corrected as shown below:

Column 4, line 6 delete "ar" insert --are--

Column 4, line 47 delete "an" insert --and--

Column 6, line 48 delete "on" insert --in--

Column 6, line 57 delete "longitudinally" insert --longitudinal--

Column 6, line 59 after "pins" and before "being" insert --contained partway therein and extending therefrom, said pair of longitudinally extending pins being in a substantially parallel alignment, at least one of said longitudinally extending pins--

Column 6, line 59 delete "latitudinal" insert --latitudinally--

Column 6 line 61 after "shaft" insert --,--

Signed and Sealed this

Twentieth Day of September, 1994

*Attest:*

Bruce Lehman

BRUCE LEHMAN

*Attesting Officer*

*Commissioner of Patents and Trademarks*